US008621726B2

(12) United States Patent
Sublette

(10) Patent No.: US 8,621,726 B2
(45) Date of Patent: Jan. 7, 2014

(54) GRIPPING ASSEMBLY FOR SECURING A SHEET OF MATERIAL

(75) Inventor: Cynthia S. Sublette, Red Oak, TX (US)

(73) Assignee: Cynthia S. Sublette, Red Oak, TX (US)

( * ) Notice: Subject to any disclaimer, the term of this patent is extended or adjusted under 35 U.S.C. 154(b) by 11 days.

(21) Appl. No.: 13/231,737

(22) Filed: Sep. 13, 2011

(65) Prior Publication Data

US 2013/0061433 A1 Mar. 14, 2013

(51) Int. Cl.
*F16B 1/00* (2006.01)

(52) U.S. Cl.
USPC ..... 24/305; 24/3.1; 24/3.13; 24/3.6; 24/298; 24/300; 24/302; 24/459

(58) Field of Classification Search
USPC ..... 24/3.1, 3.13, 3.6, 298, 300, 302, 459, 24/305, 24, 342.1, 347, 114.3, 114.73
See application file for complete search history.

(56) References Cited

U.S. PATENT DOCUMENTS

| | | | | |
|---|---|---|---|---|
| 1,399,730 | A | 12/1921 | Seikichi | |
| 2,264,185 | A | 1/1941 | Novick | |
| 2,435,082 | A | 1/1948 | Huber | |
| 2,472,235 | A | 6/1949 | Sullivan | |
| 3,530,550 | A | 9/1970 | White | |
| 3,596,329 | A * | 8/1971 | Hoban | 24/114.7 |
| 3,780,400 | A * | 12/1973 | Hinsperger | 24/16 PB |
| 4,097,969 | A * | 7/1978 | Nysten | 24/114.7 |
| 4,175,305 | A * | 11/1979 | Gillis | 24/459 |
| 4,660,240 | A * | 4/1987 | Hutton et al. | 5/669 |
| 4,757,662 | A * | 7/1988 | Gasser | 52/410 |
| 4,985,968 | A | 1/1991 | Hooper | |
| 5,033,170 | A | 7/1991 | Ewert | |
| 5,046,222 | A * | 9/1991 | Byers et al. | 24/343 |
| 5,190,336 | A * | 3/1993 | Palz | 294/147 |
| 5,209,029 | A * | 5/1993 | Foerst | 52/63 |
| 5,511,289 | A | 4/1996 | Melia | |
| 5,655,271 | A * | 8/1997 | Maxwell-Trumble et al. | 24/459 |
| 5,765,232 | A * | 6/1998 | Pryor | 2/217 |
| 5,778,904 | A * | 7/1998 | Elsner | 132/275 |
| 5,890,635 | A * | 4/1999 | Wu et al. | 224/148.4 |
| 5,940,942 | A * | 8/1999 | Fong | 24/459 |
| 6,199,247 | B1 | 3/2001 | Tsai | |
| 6,295,703 | B1 | 10/2001 | Adams et al. | |
| 6,312,449 | B1 * | 11/2001 | Chang et al. | 606/234 |
| 6,327,751 | B1 * | 12/2001 | Ikeda | 24/115 G |
| 6,973,812 | B2 * | 12/2005 | Piermattei | 70/456 R |
| 7,292,150 | B2 * | 11/2007 | Shaw | 340/573.1 |
| 7,314,334 | B1 * | 1/2008 | Bennett et al. | 404/63 |
| 8,327,510 | B2 * | 12/2012 | Schlesinger | 24/459 |
| 2002/0148081 | A1 * | 10/2002 | Ide et al. | 24/324 |
| 2004/0055120 | A1 * | 3/2004 | Gillis | 24/459 |

(Continued)

*Primary Examiner* — Robert J Sandy
*Assistant Examiner* — David Upchurch
(74) *Attorney, Agent, or Firm* — Booth Albanesi Schroeder LLC

(57) ABSTRACT

An apparatus and method of using a gripping assembly for gripping a sheet of material and attaching the sheet of material to an object is provided. The gripping assembly has a continuous ring-like member having an opening defined by an interior tapered engagement surface, a disk-like member positionable within the opening. The disk-like member has an exterior tapered engagement surface which cooperates with the tapered surface of the ring-like member. A sheet of material, threaded between the engagement surfaces is gripped by the surfaces. The disk-like member has an attachment means with at least one passageway there through. A flexible tie member extends through at least one passageway of the attachment means and is for attaching the gripping assembly to an object.

14 Claims, 4 Drawing Sheets

(56) References Cited

U.S. PATENT DOCUMENTS

| | | | | |
|---|---|---|---|---|
| 2005/0198791 | A1* | 9/2005 | Liao | 24/459 |
| 2007/0137670 | A1* | 6/2007 | Silva | 132/273 |
| 2007/0220717 | A1* | 9/2007 | Brinson | 24/298 |
| 2007/0278265 | A1* | 12/2007 | Contente | 224/162 |
| 2008/0085155 | A1* | 4/2008 | Bennett et al. | 404/63 |
| 2009/0016559 | A1* | 1/2009 | Cleary | 381/375 |
| 2009/0165264 | A1* | 7/2009 | Jones | 24/305 |
| 2010/0115732 | A1* | 5/2010 | Honeycutt | 24/3.3 |
| 2010/0199461 | A1* | 8/2010 | Usui et al. | 24/114.7 |
| 2010/0205787 | A1* | 8/2010 | Remmert | 24/302 |
| 2010/0248908 | A1* | 9/2010 | Ramsay-Matthews | 482/89 |

* cited by examiner

FIG.7
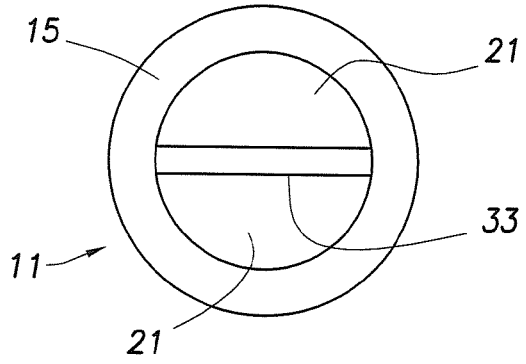
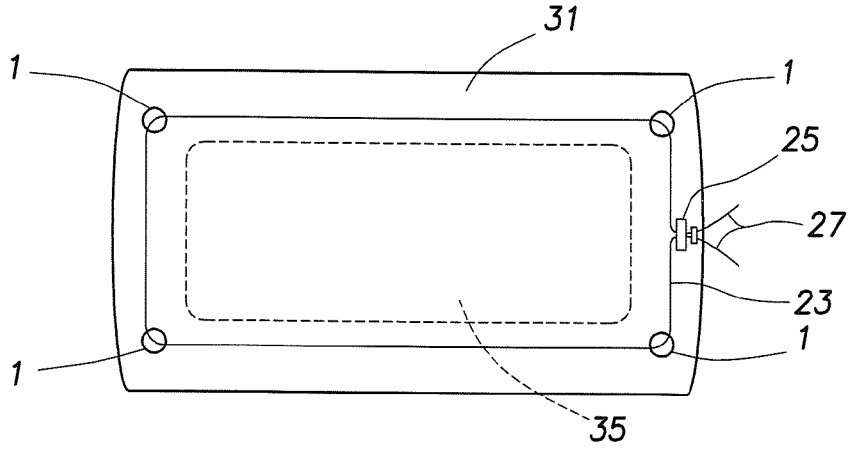
FIG.8
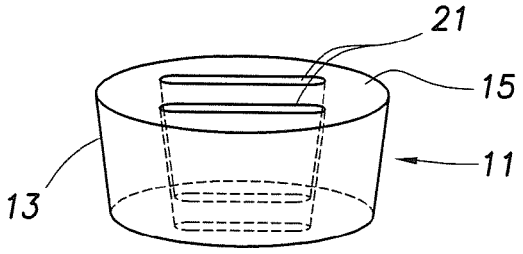
FIG.9
FIG.10
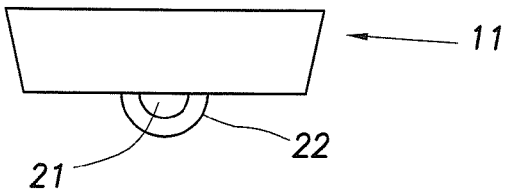

GRIPPING ASSEMBLY FOR SECURING A SHEET OF MATERIAL

BACKGROUND OF THE INVENTION

1. Field of the Invention

The present invention relates to a gripping assembly, and more particularly, a gripping assembly for gripping a sheet of material and securing the sheet of material to an object.

BRIEF DESCRIPTION OF THE DRAWINGS

FIG. 7 is a plan view of a disk-like member of an embodiment of the invention.

FIG. 8 is a perspective view of multiple gripping assemblies being used as attached to an object in an embodiment of the invention.

FIG. 9 is a perspective view of a disk-like member and attachment means of an embodiment of the invention.

FIG. 10 is an elevation view of a disk-like member and attachment means of a first embodiment of the invention.

SUMMARY

Figure 1A:
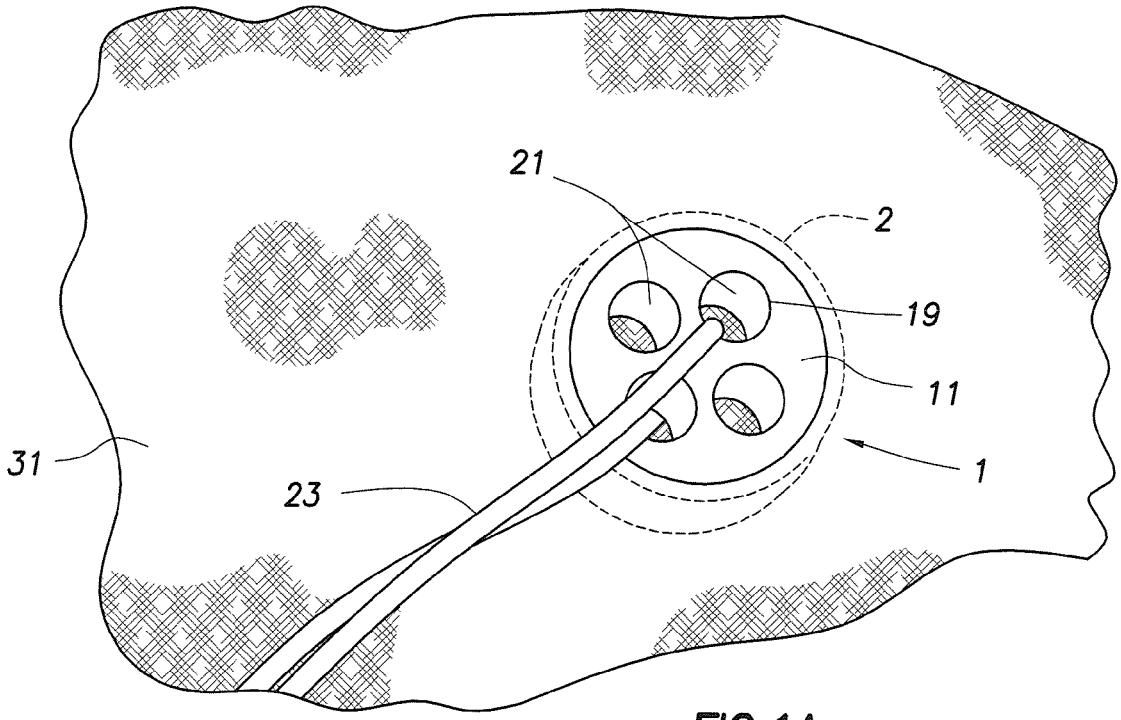
FIG. 1A-C are perspective views of the gripping assembly, assembled with a sheet of material.

An apparatus and method of using a gripping assembly for gripping a sheet of material and attaching the sheet of material to an object is provided. The gripping assembly has a continuous ring-like member having an opening defined by an interior tapered engagement surface, a disk-like member positionable within the opening. The disk-like member has an exterior tapered engagement surface which cooperates with the tapered surface of the ring-like member. A sheet of material, threaded between the engagement surfaces is gripped by the surfaces. The disk-like member has an attachment means with at least one passageway there through. A flexible tie member extends through at least one passageway of the attachment means and is for attaching the gripping assembly to an object.

DETAILED DESCRIPTION OF THE PREFERRED EMBODIMENTS

Referring now to the drawings, and initially FIG. 1-10, a gripping assembly 1 is presented in accordance with the present invention for gripping a sheet of material 31. In a preferred embodiment, the gripping assembly has a disk-like member 11, a ring-like member 2, a flexible tie member 23, an attachment means 19, and a tie-member lock 25. The function of the gripping assembly is for gripping a sheet of material 31, thereby allowing the sheet of material 31 to be secured to an object. The material can be secured to any object, such as a bed post, a pole, a tent stake, a bed of a truck, a mattress, to further gripping assemblies, or any desired other object.

Figure 1B:
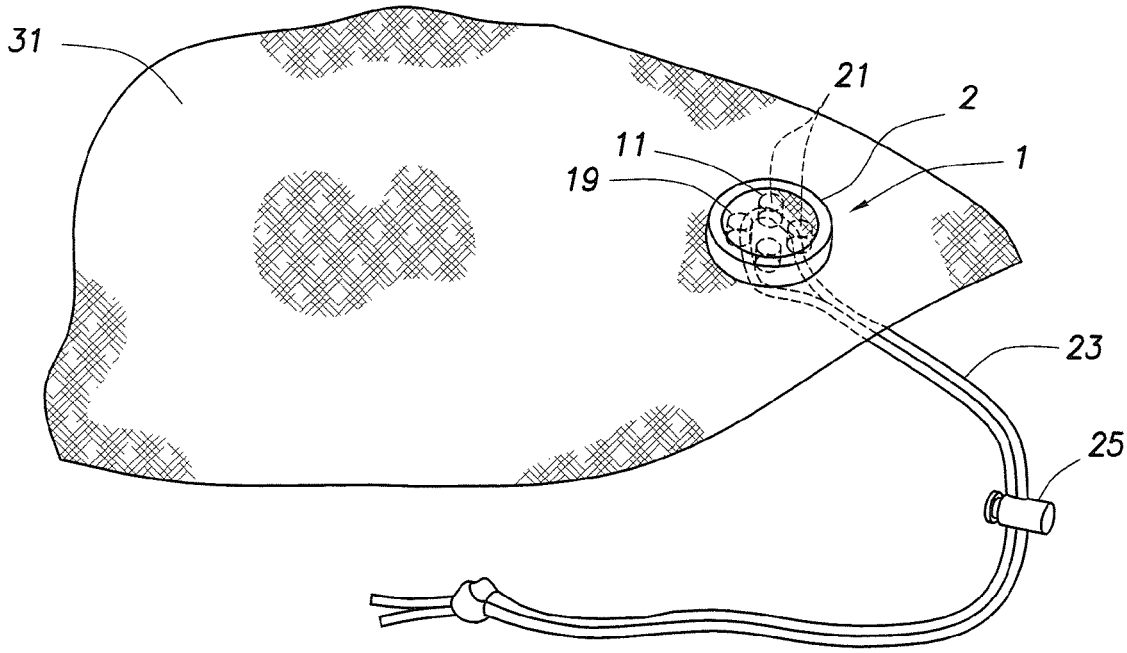
Figure 1C:
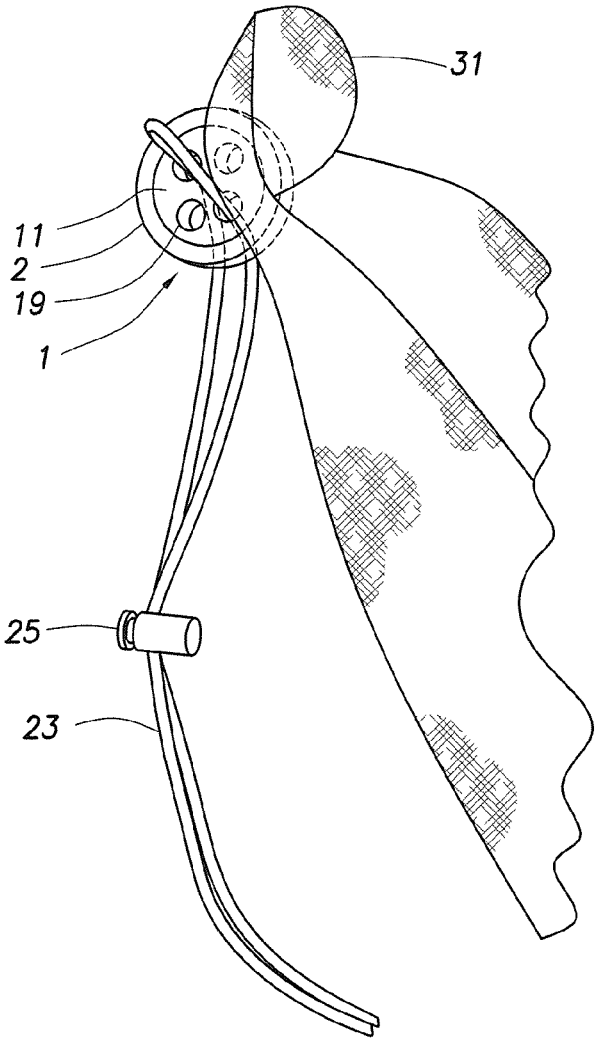
Figure 2:
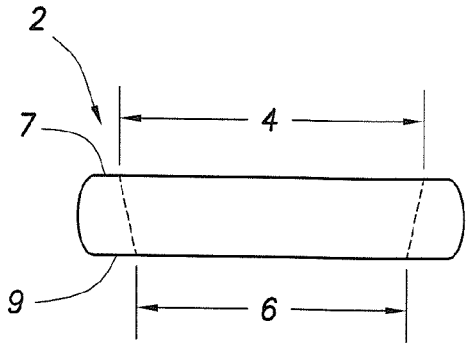
FIG. 2 is an elevation view of a ring-like member of an embodiment of the invention.
Figure 3:
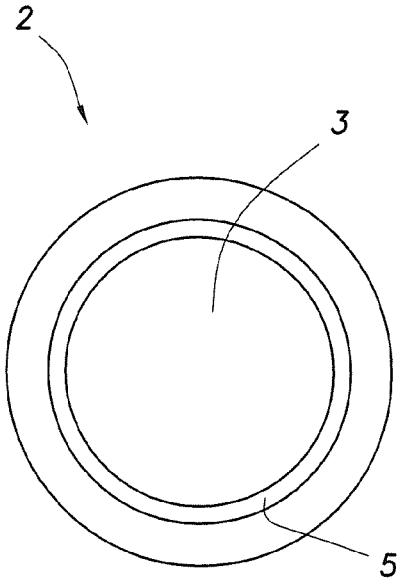
FIG. 3 is a plan view of a ring-like member of an embodiment of the invention.

FIGS. 1A-C are perspective views of the assembly, with FIG. 1A showing the top of the assembly with a sheet of material threaded through the assembly and held in place between the ring-like and disk-like members. FIG. 1B is a similar view showing the bottom of the assembly with a sheet of material anchored in place. FIG. 1C shows a sheet of material being threaded through the assembly parts and not yet ready for clamping between the ring-like and disk-like members.

The ring-like member 2 includes a top surface 7, a bottom surface 9, an opening 3, and an interior tapered engagement surface 5. The interior tapered engagement surface 5 is preferably textured to improve the gripping of material. The texturing can be grooves, scratches, or any other rough surface. The ring-like member 2 is a continuous ring and not a split ring, thereby eliminating the short-comings of split rings, which require adjustable fasteners, such as a screw extending through flanges on the ring. The tapered engagement surface 5 tapers from a maximum diameter 4, at or near the top surface 7 of the ring-like member, to a minimum diameter 6, at or near the bottom surface 9 of the ring-like member. As will be understood by those of skill in the art, the tapered engagement surface 13 of the disk-like member 11 cooperates with the tapered engagement surface 5 of the ring-like member, wedging into the internal tapered surface 5, to grippingly engage or clamp a sheet of material threaded between the disk-like and ring-like members.

The disk-like member includes a top surface 15, a bottom surface 17, and an attachment means 19 having at least one passageway 21 extending therethrough, and an exterior tapered engagement surface 13. Preferably, a raised rim 14 extends along the circumference of the top surface 15. The tapered engagement surface 13 is preferably textured to improve the gripping of the sheet of material. The tapered engagement surface 13 cooperates with the tapered engagement surface 5 of the ring-like member. The disk-like member 11 is sized to be positionable within the opening 3 of the ring-like member 2. The tapered engagement surface 13 of the disk-like member 11 has a maximum diameter 16 at or near the top surface 15 and a minimum diameter 18 at or near the bottom surface 17 of the disk-like member. In a preferred embodiment, the maximum diameter 16 of the tapered engagement surface 13 of the disk-like member 11 is greater than the minimum diameter of the tapered engagement surface 5 of the ring-like member 2. In such an embodiment, the disk-like member will not fit through the opening of the ring-like member. In an alternate embodiment, the diameters are selected such that the disk-like member 11 will not fit through the ring-like member 2 opening 3 when a sheet of material 31 is positioned between the engagement surfaces 5, 13.

Further, the cooperation of the tapered surfaces and relative diameters can be selected based on the thickness and type of sheet of material to be used. For example, where a relatively thicker sheet of material is to be used, such as a tarp, the difference between the respective diameters of the tapered surfaces may be greater, allowing the members to cooperate when the thicker material is in position between the tapered surfaces. Where a thinner material is used, such as a sheet, the difference between the relative diameters is preferably smaller. Similarly, the sizes of the disk-like and ring-like members may be larger where a less flexible material is to be used, thereby allowing the sheet of material to be threaded more easily between the tapered surfaces.

The ring-like member 2 and disk-like member 11 are preferably made of plastic, nylon, rubber, or metal. As will be apparent to those of skill in the art, the material of the disk-like and ring-like members can be any material allowing for a friction fit between the members when a sheet of material is interposed between them.

Figure 4:
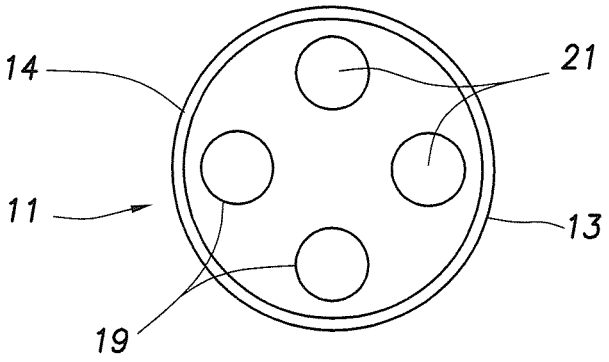
FIG. 4 is a plan view of a disk-like member of an embodiment of the invention.
Figure 5:
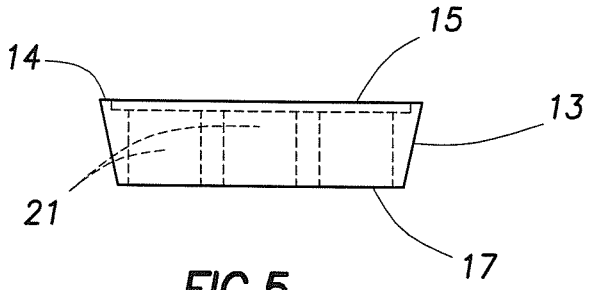
FIG. 5 is a elevation view of a disk-like member of an embodiment of the invention.
Figure 6:
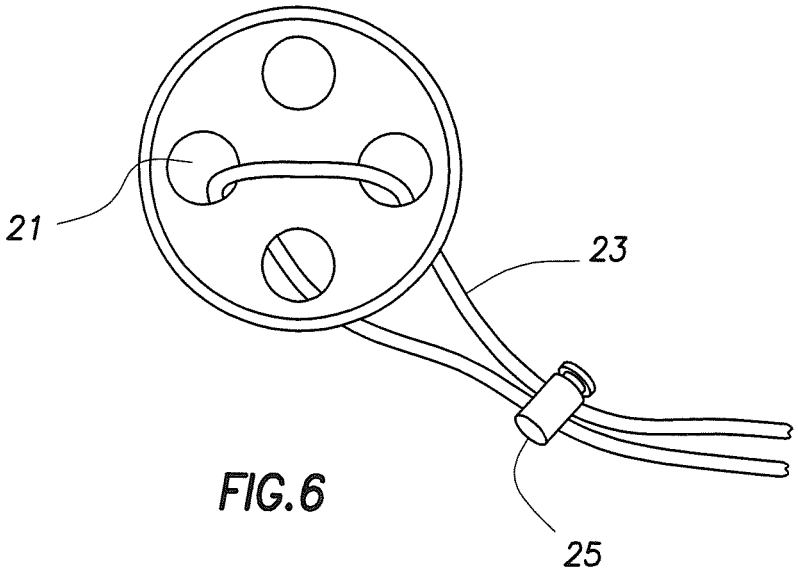
FIG. 6 is a plan view of a disk-like member, flexible tie member, and tie member lock of an embodiment of the invention.

The attachment means 19 is for attaching a flexible tie member 23 to the gripping assembly. The attachment means 19 defines at least one passageway 21 through which a flexible tie member 23 can be threaded. The attachment means 19 may be an integral part of the disk-like member 11, such as the passageways 21 through the disk-like member 11 as seen in FIGS. 4 and 6. Alternately, as seen in FIG. 10, the passageway 21 may extend through a separately identifiable part of the disk-like member 11, such as a shank 22. For example, the attachment means 19 may have one or more passageways 21 extending completely through the disk-like member 11, as shown in FIGS. 4, 6 and 9, or a shank extending from the bottom surface 17 of the disk-like member 11, as shown in FIG. 10. In FIG. 7, the passageways 21 extend on either side of a post or rod 33 spanning the opening 3.

The flexible tie member 23 is preferably a cord, strap, string, rope, band, or belt. The flexible tie member 23 can be made of various materials, including natural or synthetic materials, such as nylon straps or cords or natural-fiber ropes or strings. The tie member 23 is threaded through at least one of the passageways 21 of the attachment means 19.

The flexible tie member 23 may be attached to the disk-like member 11 such that it has two free ends 27, as seen in FIG. 6. Alternately, the tie member 23 may be attached to the disk-like member 11 such that it has only one free end, as, for example, where the tie member is threaded through the at least one passageway 21 and then tied, stitched or fused to itself at the free end. For example, a nylon strap may be threaded through the passageways 21, as seen in FIG. 9, with one end then stitched to the free end of the nylon strap. Note that the passageways 21 in FIG. 9 are sized and shaped to accept a strap.

A tie member lock 25 is preferably used. The tie member lock 25 can be a cord lock, spring-loaded lock (as shown), clamp, buckle, clasp, locking slide, cam buckle, strap adjuster, snap hook, bolt snap, double ring, or ratchet. Other locks will be apparent to those of skill in the art. The tie member lock 25 can be releasably attached to the tie member, such as the spring-loaded cord lock shown, which can be slid off the tie member. Further, the tie member lock can selectively allow and prevent relative movement between the free ends (or other portions) of the tie member. Alternately, the tie member lock can be permanently attached to the tie member, such as with a buckle. The tie member lock can slidably engage the tie member, such as on the cord lock shown. The cord lock shown accommodates two free ends 27 of the flexible tie member 23 for adjusting and tightening the fit of the gripping assembly 1 and for securing the flexible tie member 23 in place and thereafter to an object. The tie lock is used to move the gripping assembly, and sheet of material gripped thereby, relative to the object to which it is attached. For example, the tie lock can be used to "cinch" the assembly closer to the object.

The sheet of material 31 is gripped by the disk-like member and the ring-like member. The sheet of material can be anchored to a post, truck bed, etc. by the gripping assembly 1. The sheet of material can be any flexible sheet of material including a tarp, a bed sheet, a canvas material, etc. The flexible sheet of material can be a tent, an awning, a cover, a top sheet, a plastic tarp, etc. The sheet of material is of such a thickness that the disk-like member cannot be pulled completely through the ring-like member when the sheet of material is fitted and engaged in the gripping assembly. When the interior tapered engagement surface 5 of the ring-like member 2 and the exterior tapered engagement surface 13 of the disk-like member 11 are fully cooperating, the sheet of material 31 is secured to the gripping assembly.

The tie member 23 is used to attach the gripping assembly 1 securely to a desired object. The object can be a bed post, a tent stake, a bed of a truck, or any other object to which the gripping assembly can be secured. The flexible tie member 23 can also connect multiple gripping assemblies 1 to one another, as shown in FIG. 8. In such an arrangement, the gripping assemblies 1 are connected by the flexible tie member 23 and can be cinched together by pulling one or both of the free ends 27 of the tie member 23. The tie member lock 25 can be used to selectively allow or prevent relative movement of the free ends. In such a way, the sheet of material 31 can be secured over a bed 35, such as securing a tarp over a loaded truck bed or tightly securing a bed sheet to a mattress.

Referring now to the method of use of the gripping assembly, a sheet of material 31, is threaded between the interior tapered engagement surface 5 of the ring-like member 2 and the exterior tapered engagement surface 13 of the disk-like member 11 and covers the top surface 15 of the disk-like member. The disk-like member 11 is positioned in the opening 3 of the ring-like member 2. A friction fit is created between the tapered engagement surfaces 5, 13 with the sheet of material 31 gripped securely there between. The method includes moving the disk-like member 11 and ring-like member 2 relative to one another to allow for a secure grip of the sheet of material 31. The flexible tie member 23 is connected to the attachment means 19 of the disk-like member 11. The relative movement can be accomplished by pulling the flexible tie member 23, pulling the sheet of material 31, or by pushing down on the top surface of the disk-like member and thereby creating a friction fit.

The gripping assembly 1 is attached by the tie member 23 to a desired object, such as a post, pole, stake, truck bed, etc. The tie member 23 is then adjusted to move the gripping assembly, and the sheet of material, with respect to the object. For example, the gripping assembly is pulled in closer proximity to a tent post to tighten or erect a tent, or a tarp is pulled tightly over a bed of a truck.

The flexible tie member 23 is preferably attached to a tie member lock 25. The tie member lock can be moved relative to one or both free ends of the tie member, or relative to portions of the tie member. The lock preferably selectively allows or prevents relative movement of portions of the tie member. The flexible tie member 23 is pulled or otherwise moved in relation to the lock, allowing for an adjusted tight and secure fit of the gripping assembly 1.

The gripping assembly, in accordance with the present invention, may be used in combination with multiple gripping assemblies to secure a tarp to the bed of a truck at all corners, tightly fit a sheet to a mattress at all corners, etc. as shown in FIG. 8.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

What is claimed:

1. A gripping assembly for gripping a sheet of material and attaching the sheet of material to an object, the gripping assembly comprising:

a continuous ring member having a top surface, a bottom surface, and an opening therethrough, the opening extending from the top surface to the bottom surface of the ring member and defined by an interior tapered engagement surface of the ring, member;

a disk member having an exterior tapered engagement surface, a top surface, and a bottom surface, the disk member having an attachment means defining at least one passageway therethrough, the disk member positionable in the opening of the ring member, the exterior tapered surface of the disk member and the interior tapered surface of the ring member for cooperating with one another to grip a sheet of material threaded between the ring member and disk member; and a flexible tie member extending through at least one passageway of the attachment means, the tie member for attaching the gripping assembly to an object.

2. The gripping assembly according to claim 1, wherein at least one of the ring member and disk member is made of plastic, nylon, rubber, or metal.

3. The gripping assembly according to claim 1, further comprising a tie lock member.

4. The gripping assembly according to claim 1, wherein said flexible tie member is a cord, strap, string, rope, band, or belt.

5. The gripping assembly according to claim 3, wherein the tie lock member adjustably attaches to the flexible tie member.

6. The gripping assembly according to claim 5, wherein the tie lock member is in sliding engagement with the flexible tie member.

7. The gripping assembly according to claim 3, wherein the flexible tie member has two free ends, the tie lock member engaging each free end of the flexible tie member.

8. The gripping assembly according to claim 1, wherein at least one of the attachment means passageways has one end of terminating at the top surface and one end terminating at the bottom surface of the disk member.

9. The gripping assembly according to claim 1, wherein the tapered surfaces are brought into a tighter friction fit by pulling the flexible tie member or the sheet of material.

10. The gripping assembly according to claim 1, wherein at least one of the tapered engagement surfaces is textured.

11. The gripping assembly according to claim 1, wherein the disk member includes a raised rim along the circumference of the top surface.

12. The gripping assembly according to claim 1, further comprising multiple gripping assemblies, and wherein the flexible tie member connects the multiple gripping assemblies.

13. The gripping assembly according to claim 1, wherein the maximum diameter of the tapered engagement surface of the disk member is greater than the minimum diameter of the tapered engagement surface of the ring member.

14. The gripping assembly according to claim 1, wherein the disk member will not fit through the opening of the ring member when a sheet of material is positioned between the engagement surfaces.

* * * * *